US007015787B2

(12) United States Patent
Nakamura

(10) Patent No.: US 7,015,787 B2
(45) Date of Patent: Mar. 21, 2006

(54) VOLTAGE-DEPENDENT RESISTOR AND METHOD OF MANUFACTURING THE SAME

(75) Inventor: Kazutaka Nakamura, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 59 days.

(21) Appl. No.: 10/756,459

(22) Filed: Jan. 14, 2004

(65) Prior Publication Data

US 2004/0155750 A1 Aug. 12, 2004

(30) Foreign Application Priority Data

Feb. 10, 2003 (JP) ..... 2003-032637

(51) Int. Cl.
*H01C 7/10* (2006.01)

(52) U.S. Cl. ..... 338/20; 338/21

(58) Field of Classification Search ..... 338/20, 338/21

See application file for complete search history.

(56) References Cited

U.S. PATENT DOCUMENTS

| | | | | | |
|---|---|---|---|---|---|
| 3,764,951 | A | * | 10/1973 | Tachibana et al. | 338/20 |
| 3,953,371 | A | * | 4/1976 | May | 252/512 |
| 4,097,834 | A | * | 6/1978 | Mar et al. | 338/21 |
| 4,272,754 | A | * | 6/1981 | Lou | 338/21 |
| 4,285,839 | A | * | 8/1981 | Wong | 252/519.5 |
| 4,383,237 | A | * | 5/1983 | Eda et al. | 338/21 |
| 4,400,683 | A | * | 8/1983 | Eda et al. | 338/21 |
| 5,008,646 | A | * | 4/1991 | Hennings et al. | 338/20 |
| 5,296,835 | A | * | 3/1994 | Nakamura | 338/130 |

FOREIGN PATENT DOCUMENTS

| | | | | |
|---|---|---|---|---|
| JP | 50-70898 | * | 10/1973 | |
| JP | 1-125902 | * | 5/1989 | 338/21 |
| JP | 01-200604 | | 8/1989 | |
| JP | 1-200604 | * | 8/1989 | 427/419.3 |
| JP | 2-2141101 | * | 8/1990 | 338/20 |
| JP | 05-226116 | | 9/1993 | |

* cited by examiner

*Primary Examiner*—Karl D. Easthom
(74) *Attorney, Agent, or Firm*—Dickstein, Shapiro, Morin & Oshinsky, LLP.

(57) ABSTRACT

A voltage-dependent resistor includes a composite of at least one semiconductive ceramic layer mainly containing ZnO and at least one metal oxide layer containing at least one of strontium and barium, at least one of manganese and cobalt, and at least one rare earth element. The material for the at least one metal oxide layer is represented by the general formula $M_{1-x}A_xBO_3$ where M indicates the at least one rare earth element; A indicates the at least one of strontium and barium; B indicates the at least one of manganese and cobalt; and $x \leqq 0.4$. The at least one semiconductive ceramic layer, which is an n-type semiconductor, is doped with a trivalent dopant. The total number of the at least one semiconductive ceramic layer and the at least one metal oxide layer is at least three.

12 Claims, 4 Drawing Sheets

VOLTAGE-DEPENDENT RESISTOR AND METHOD OF MANUFACTURING THE SAME

BACKGROUND OF THE INVENTION

1. Field of the Invention

The present invention relates to voltage-dependent resistors. In particular, the present invention relates to a voltage-dependent resistor having high thermal resistance, high surge withstand capability, and stability in its characteristics.

2. Description of the Related Art

As an example of voltage-dependent resistors, Japanese Unexamined Patent Application Publication No. 5-226116 (Patent Document 1) discloses a multilayer varistor using ceramic grain boundary barriers.

This multilayer varistor includes semiconductive ceramic layers that mainly contain ZnO and are doped with bismuth, inner electrode layers, and outer electrodes. The semiconductive ceramic layers and the inner electrode layers are alternately laminated and co-fired. The outer electrodes are disposed on both end surfaces of this composite. One end of each inner electrode layer is alternately electrically connected to either outer electrode.

For another example, Japanese Unexamined Patent Application Publication No. 1-200604 (Patent Document 2) discloses a junction voltage-dependent resistor using a ceramic potential barrier.

This junction voltage-dependent resistor is a ZnO varistor shown in FIG. 4. In FIG. 4, at least one ZnO layer 53 mainly containing ZnO and at least one metal oxide layer 54 are alternately laminated on an electrode 52 disposed on a substrate 51. The ZnO layer 53 and the metal oxide layer 54 are crystallized during their formation to form a potential barrier 55. The ZnO varistor includes another electrode 56 for allowing current to flow through the junction between the ZnO layer 53 and the metal oxide layer 54.

In this ZnO varistor, the potential barrier 55 can be reliably formed because the metal oxide layer 54 is crystallized during its formation. Such a potential barrier 55 improves the nonlinearity and thermal stability of the ZnO varistor. In addition, this ZnO varistor does not require heat treatment after formation of the metal oxide layer 54, preventing cracks on the ZnO layer 53 and the metal oxide layer 54.

The ZnO varistor in Patent Document 1 uses potential barriers that occur at the boundaries between Bi-doped crystal grains to achieve varistor characteristics. This ZnO varistor unfortunately has difficulty in precisely achieving target varistor characteristics because the number of potential barriers and the varistor voltage vary according to, for example, the concentration of oxygen absorbed in the grain boundaries and variations in the diameter of the crystal grains due to the grain growth.

Such a junction voltage-dependent resistor as in Patent Document 2 includes a ZnO layer and a metal oxide layer that are made of thin films deposited by sputtering. Deposition of such thin films needs, for example, a highly clean atmosphere and high vacuum, and involves a difficult defect control of ZnO, which is a semiconductor. In addition, when voltage is applied to the junction voltage-dependent resistor, which is not co-fired, the ZnO layer and the metal oxide layer diffuse into each other at their junction. Furthermore, such thin films readily crack due to the difference in thermal expansion from a substrate on which the thin films are deposited. As a result, unfortunately, the junction voltage-dependent resistor fails to withstand a satisfactory amount of energy, exhibiting an unsatisfactory surge withstand capability.

SUMMARY OF THE INVENTION

Accordingly, an object of the present invention is to provide a compact, reliable junction voltage-dependent resistor that has high voltage resistance, high thermal resistance, and other desirable characteristics and that can prevent variations in its characteristics.

A wide variety of experiments and studies by the present inventor have found that a junction of a semiconductive ceramic layer mainly containing ZnO and a metal oxide layer containing at least one of strontium and barium, at least one of manganese and cobalt, and at least one rare earth element can provide a potential barrier and, therefore, a desirable nonlinear resistance.

A voltage-dependent resistor according to the present invention includes a composite of at least one semiconductive ceramic layer mainly containing ZnO and at least one metal oxide layer containing at least one of strontium and barium, at least one of manganese and cobalt, and at least one rare earth element, the composite including at least one junction of the at least one semiconductive ceramic layer and the at least one metal oxide layer; and electrodes disposed at predetermined positions on the composite such that current flows through the at least one junction.

The junction (p-n junction or M-n junction) of the semiconductive ceramic layer (n-type semiconductor (n)) and the metal oxide layer (p-type semiconductor (p) or metal conductive material (M)) can provide an excellent nonlinear resistance. Therefore, the present invention can provide a voltage-dependent resistor (for example, a diode or a varistor) having high voltage linearity, low resistance, and stability in its characteristics.

Essentially, the voltage-dependent resistor of the present invention does not use potential barriers at grain boundaries but rather, uses a potential barrier at the junction of the semiconductive ceramic layer and the metal oxide layer. The voltage-dependent resistor, therefore, requires a semiconductive ceramic layer that has low resistance, namely, that serves as a semiconductor.

The semiconductive ceramic layer and the metal oxide layer preferably have low resistivity, namely, about 0.001 to several Ω·mm, and do not require an electrode for the junction. The present invention, therefore, can provide a simple, compact, and low-cost voltage-dependent resistor.

An inner electrode, though not being necessary, may be used in the voltage-dependent resistor of the present invention. The use of an inner electrode provides an excellent ohmic contact to the semiconductive ceramic layer or the metal oxide layer. The inner electrode, if formed on a side on which an excellent ohmic contact cannot be provided, causes an undesirable potential barrier. For example, a platinum or palladium inner electrode is preferably formed on the metal oxide layer side.

In the present invention, the electrodes disposed at predetermined position on the composite, for example, a pair of electrodes, may be formed on either layer of the composite unless the electrodes are formed on the same layer (that is, the same semiconductive ceramic layer or the same metal oxide layer). The pair of electrodes may be formed on the same type of layers.

The material for the metal oxide layer is preferably represented by the following general formula (1):

$$M_{1-x}A_xBO_3 \quad (1)$$

where M indicates the at least one rare earth element; A indicates the at least one of strontium and barium; B indicates the at least one of manganese and cobalt; and $x \leqq 0.4$.

Such a metal oxide layer can reliably provide a voltage-dependent resistor having desirable characteristics.

For example, $La_{1-x}Sr_xMnO_3$ is more preferable for the metal oxide layer. Strontium allows the metal oxide layer to have low resistance, improving the nonlinearity of the voltage-dependent resistor at high currents.

The value of x in $M_{1-x}A_xBO_3$ is preferably 0.4 or less not only to decrease the resistance of the metal oxide layer but also to improve the voltage restraint capability for withstanding a transient voltage such as a surge. If the value of x exceeds 0.4, the metal oxide layer causes difficulty in co-firing with the semiconductive ceramic layer, failing to achieve a sufficiently strong junction.

The at least one semiconductive ceramic layer is preferably doped with a trivalent dopant.

The trivalent dopant serves as a donor in the semiconductive ceramic layer, which is an n-type semiconductor. This trivalent dopant, therefore, can decrease the resistance of the semiconductive ceramic layer and improve the voltage nonlinearity.

The content of the trivalent dopant is preferably 100 ppm or less so as not to decrease the insulation resistance.

The total number of the at least one semiconductive ceramic layer and the at least one metal oxide layer is preferably at least three.

Such a composite has a larger range of control on the characteristics of the voltage-dependent resistor and a larger degree of freedom to design the voltage-dependent resistor.

For example, the voltage-dependent resistor, including a plurality of p-n junctions, can provide a breakdown voltage of approximately a multiple of 4 V. In addition, variations in the breakdown voltage of the voltage-dependent resistor are about one tenth as large as those of a commercially available multilayer varistor due to little variations in the breakdown voltage at each junction. Furthermore, the nonlinearity of the voltage-dependent resistor is about two times as large as the commercially available multilayer varistor.

The semiconductive ceramic layer and the metal oxide layer have low resistivity, can be sintered at high temperature, and have low clamping voltage. These layers, therefore, may be efficiently used to provide a voltage-dependent resistor having little change due to a surge.

The thickness and cutting size of the composite may be decreased to provide a more compact voltage-dependent resistor easily.

The semiconductive ceramic layer and the metal oxide layer are exemplified by (a) a semiconductive ceramic sheet mainly containing ZnO and a metal oxide sheet; (b) a semiconductive ceramic block formed by laminating a plurality of semiconductive ceramic sheets and a metal oxide block formed by laminating a plurality of metal oxide sheets; and (c) a combination of (a) and (b), though not being limited.

In this voltage-dependent resistor, insulating layers are preferably formed on surfaces on which the electrodes are not formed.

These insulating layers can improve the voltage resistance, weather resistance, environmental resistance, and, therefore, reliability of the voltage-dependent resistor.

The composite is preferably formed by co-firing the at least one semiconductive ceramic layer and the at least one metal oxide layer.

Such a composite can provide a reliable voltage-dependent resistor (diode or varistor) having high integrity and little variations in its characteristics. Furthermore, when power or heat is applied to such a voltage-dependent resistor, the materials of the voltage-dependent resistor do not diffuse into each other at the junction. Therefore, the voltage-dependent resistor has stable characteristics.

BRIEF DESCRIPTION OF THE DRAWINGS

FIG. 1A is an exploded perspective view of a composite of semiconductive ceramic sheets and metal oxide sheets in this voltage-dependent resistor; FIG. 1B is a sectional view of this voltage-dependent resistor; and FIG. 1C is a sectional view of a modification of this voltage-dependent resistor.

FIG. 2A is an exploded perspective view of a composite of the semiconductive ceramic sheets and the metal oxide sheets in this voltage-dependent resistor; FIG. 2B is a sectional view of this voltage-dependent resistor; and FIG. 2C is a sectional view of a modification of this voltage-dependent resistor.

FIG. 3A is an exploded perspective view of a composite of the semiconductive ceramic sheets and the metal oxide sheets in this voltage-dependent resistor; and FIG. 3B is a sectional view of this voltage-dependent resistor.

DESCRIPTION OF THE PREFERRED EMBODIMENTS

Figure 1A:
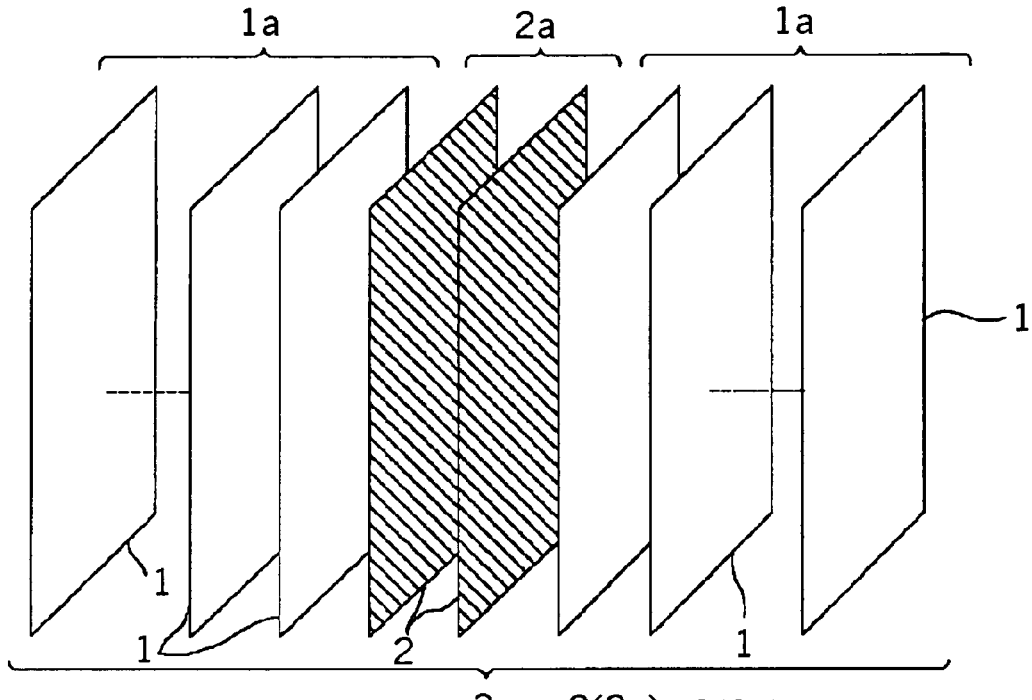
FIGS. 1A, 1B, and 1C illustrate a method for manufacturing a voltage-dependent resistor according to an embodiment of the present invention.

Preferred embodiments of the present invention will now be described in detail.

(1) Lanthanum oxide, cerium oxide, praseodymium oxide, samarium oxide, gadolinium oxide, dysprosium oxide, and erbium oxide; strontium carbonate and barium carbonate; and manganese oxide and cobalt oxide were weighed and wet-mixed in a ball mill according to compositions shown in Table 1. The resultant mixtures were dried by evaporation and calcined at 1000° C. to provide compounds represented by the general formula $M_{1-x}A_xBO_3$, where M represents at least one rare earth element; A represents at least one of strontium and barium; B represents at least one of manganese and cobalt; and $x \leqq 0.4$ (molar ratio).

The calcination allows manganese and cobalt to react sufficiently with the other metal oxide by heating, thereby preventing the diffusion of manganese and cobalt when baking a semiconductor ceramics and an oxide compound integrally. The diffusion of manganese to ZnO is smaller than that of cobalt to ZnO, so that manganese can be baked integrally with ZnO more easily than cobalt.

The resultant compounds were then milled to 1 μm or less in grain diameter in the ball mill to prepare metal oxide materials.

In Table 1, the composition of Run. No. M* includes $SrCO_3$ in the molar ratio of 0.5, which deviates from $x \leqq 0.4$. This composition, therefore, is not included in the scope of the present invention, while the other compositions are included in the scope of the present invention.

TABLE 1

| Run. No. | M (Kind) (Molar ratio) | $SrCO_3$ (Molar ratio) | $BaCO_3$ (Molar ratio) | $Mn_3O_4$ (Molar ratio) | $Co_3O_4$ (Molar ratio) |
|---|---|---|---|---|---|
| A | La 0.7 | 0.3 | — | 1.0 | — |
| B | Ce 0.7 | 0.3 | — | 1.0 | — |
| C | Pr 0.7 | 0.3 | — | 1.0 | — |
| D | Sm 0.7 | 0.3 | — | 1.0 | — |
| E | Gd 0.7 | 0.3 | — | 1.0 | — |
| F | Dv 0.7 | 0.3 | — | 1.0 | — |
| G | Er 0.7 | 0.3 | — | 1.0 | — |
| H | La 0.7 | — | 0.3 | 1.0 | — |
| I | La 1.0 | — | — | 1.0 | — |
| J | La 0.9 | 0.1 | — | 1.0 | — |
| K | La 0.8 | 0.2 | — | 1.0 | — |
| L | La 0.6 | 0.4 | — | 1.0 | — |
| M‡ | La 0.5 | 0.5 | — | 1.0 | — |
| N | La 0.7 | 0.3 | — | — | 1.0 |

The columns of $Mn_3O_4$ and $Co_3O_4$ show the molar ratios of elemental manganese and cobalt.
*M is outside the scope of the present invention.

(2) ZnO was wet-mixed with $Al_2O_3$, $In_2O_3$, or $Ga_2O_3$ according to compositions shown in Table 2. The resultant mixtures were dried by evaporation, calcined at 1000° C., and milled in the ball mill to 1 μm or less in grain diameter to prepare semiconductive ceramic materials mainly containing ZnO. These semiconductive ceramic materials do not contain bismuth or praseodymium.

TABLE 2

| Type of semiconductive ceramic material | Type and amount of additive | | |
|---|---|---|---|
| | $Al_2O_3$ (ppm) | $In_2O_3$ (ppm) | $Ga_2O_3$ (ppm) |
| Z-a | — | — | — |
| Z-b | 10 | — | — |
| Z-c | 100 | — | — |
| Z-d | 1000 | — | — |
| Z-e | 10000 | — | — |
| Z-f | — | 1000 | — |
| Z-g | — | — | 1000 |

(3) Ethanol, toluene, and a dispersant were added to the metal oxide materials and the semiconductive ceramic materials to prepare dispersion liquids. Then, a binder and a plasticizer were added to the dispersion liquids to prepare slurries.

(4) These slurries were shaped by the doctor blade method into semiconductive ceramic sheets 1 and metal oxide sheets 2 having thicknesses of 30±2 μm.

(5) These semiconductive ceramic sheets 1 and metal oxide sheets 2 were cut to a predetermined size. Then, predetermined numbers of semiconductive ceramic sheets 1 and metal oxide sheets 2 were laminated as shown in FIGS. 1A, 2A, and 3A and clamped into composites 3 (conjunction structure) having a predetermined thickness in FIGS. 1B, 2B, and 3B, where composites 3*a* refer to the composites 3 after baking integrally.

Figure 1B:
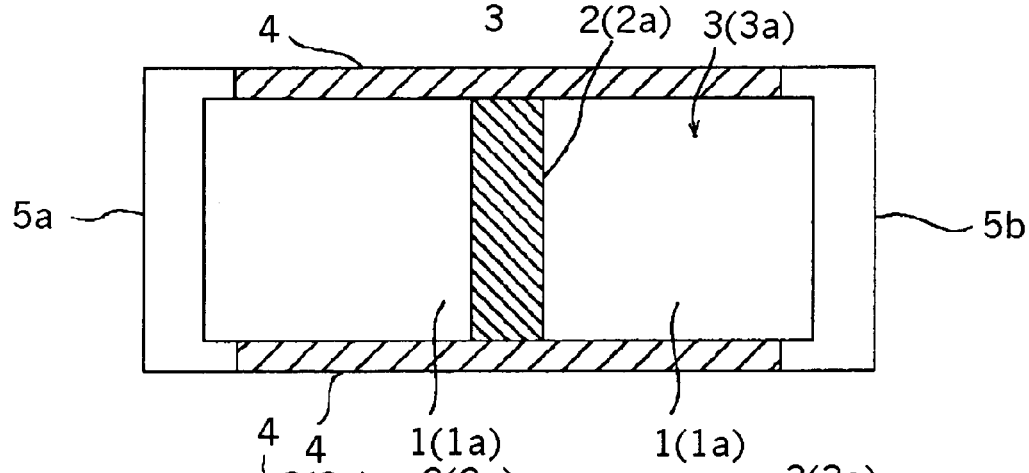

In the composites 3 in FIGS. 1A and 1B, a metal oxide block 2*a* formed by laminating a predetermined number of metal oxide sheets 2 is disposed between semiconductive ceramic blocks 1*a* formed by laminating a predetermined number of semiconductive ceramic sheets 1.

Figure 2A:
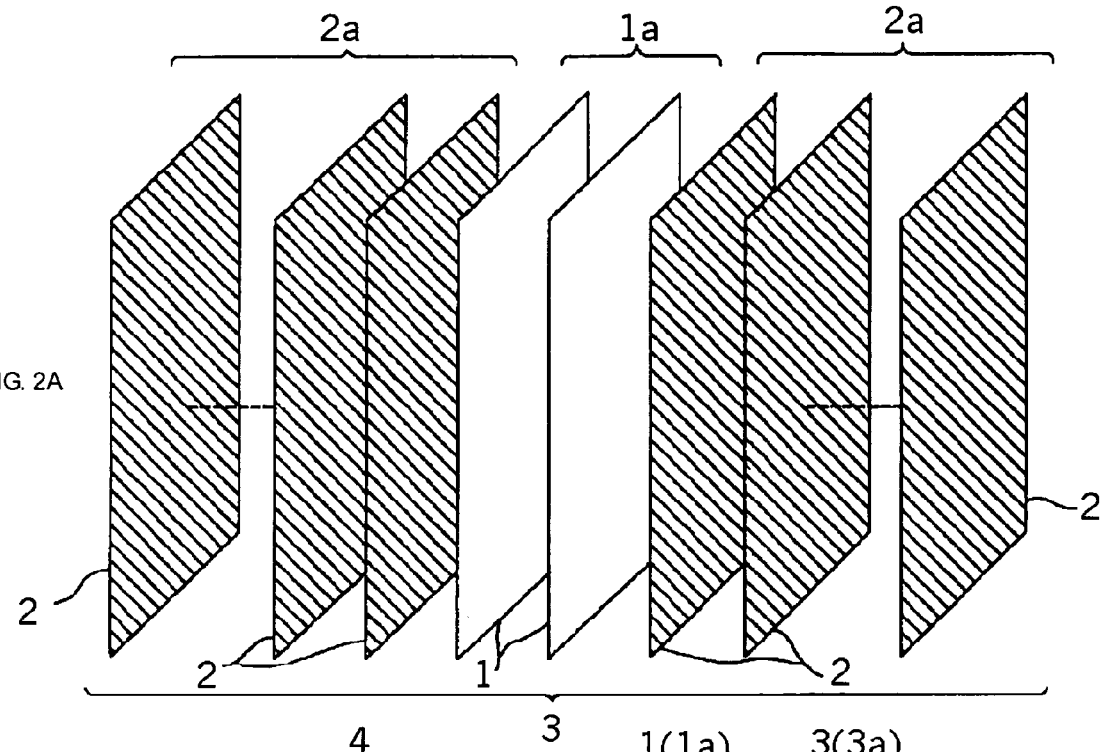
FIGS. 2A, 2B, and 2C illustrate a method for manufacturing a voltage-dependent resistor according to another embodiment.
Figure 2B:
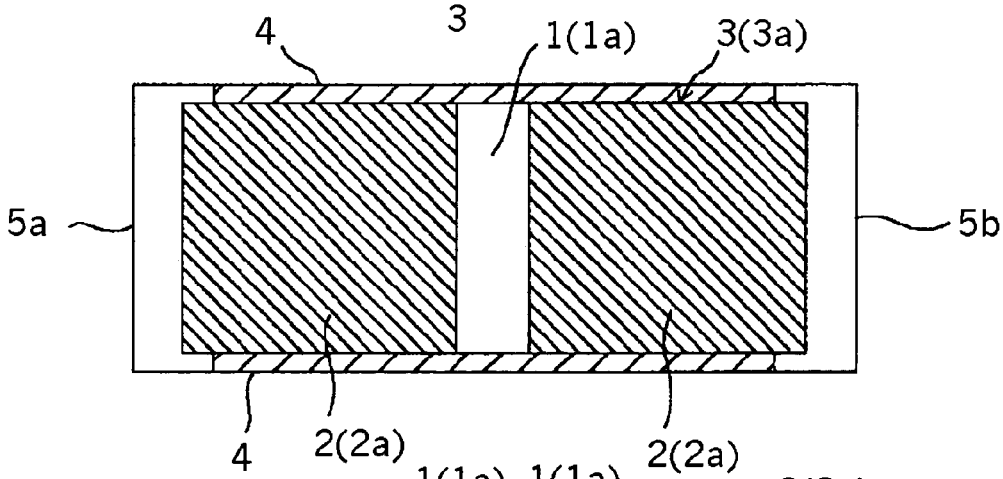

In the composites 3 in FIGS. 2A and 2B, one semiconductive ceramic block 1*a* is disposed between two metal oxide blocks 2*a*.

Figure 3A:
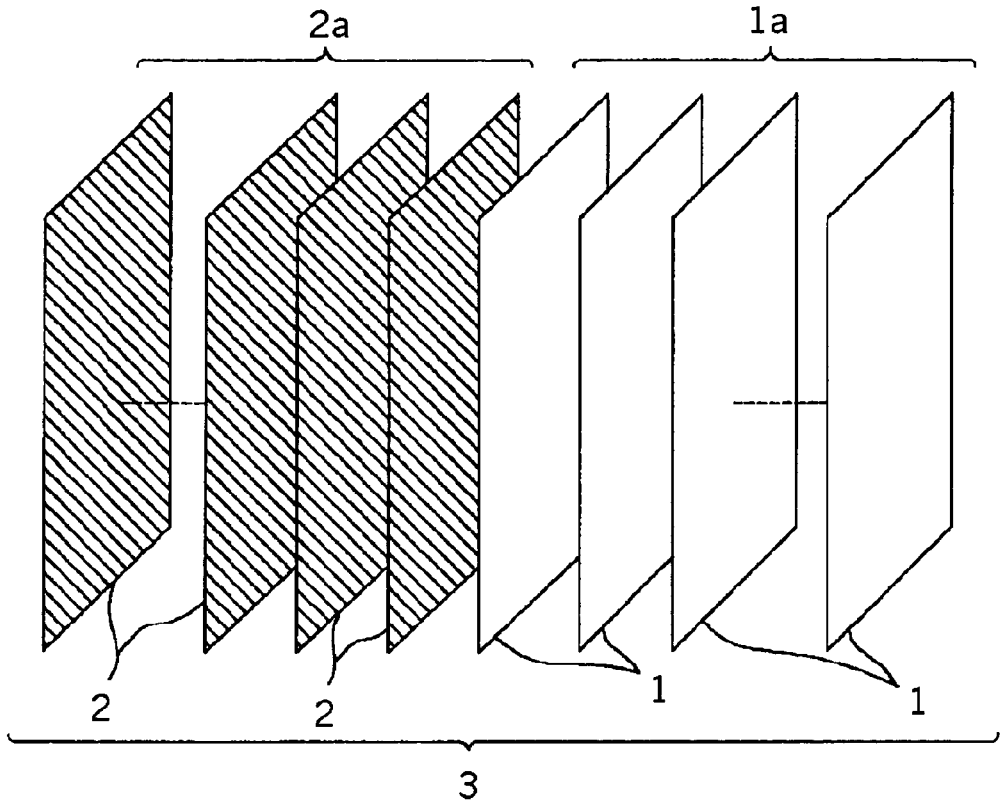
FIGS. 3A and 3B illustrate a method for manufacturing a voltage-dependent resistor according to still another embodiment.
Figure 3B:
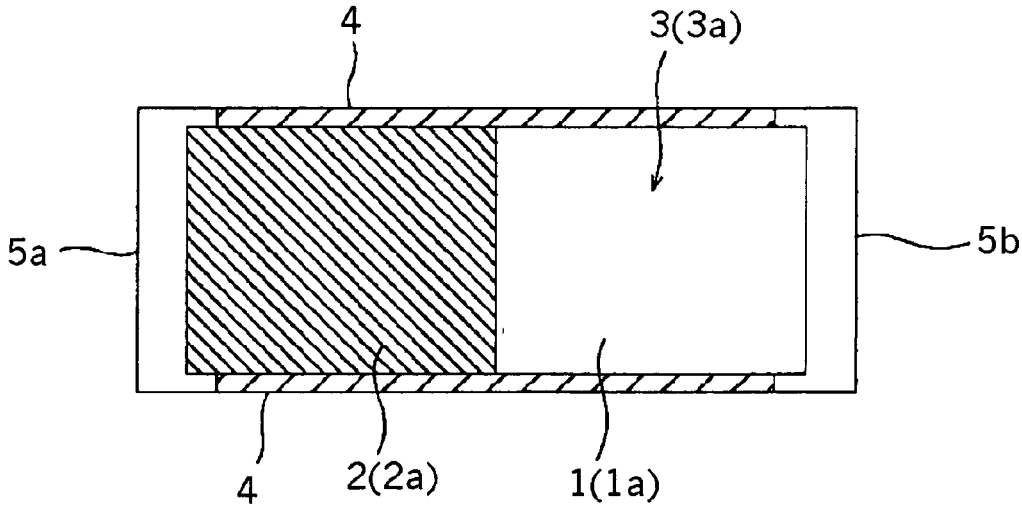
Figure 4:
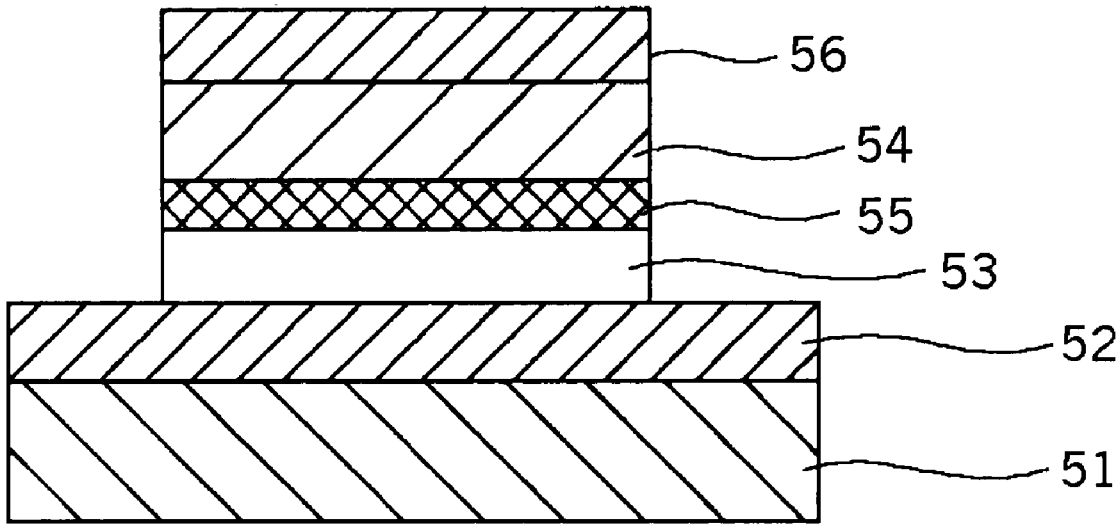
FIG. 4 illustrates the structure of a known ZnO varistor.

In the composites 3 in FIGS. 3A and 3B, one semiconductive ceramic block 1*a* and one metal oxide block 2*a* have a junction.

The number of semiconductive ceramic sheets or metal oxide sheets that constitute the outermost layers was determined for every composite 3 so that the clamped composites 3 had a thickness of 1 mm.

Figure 1C:
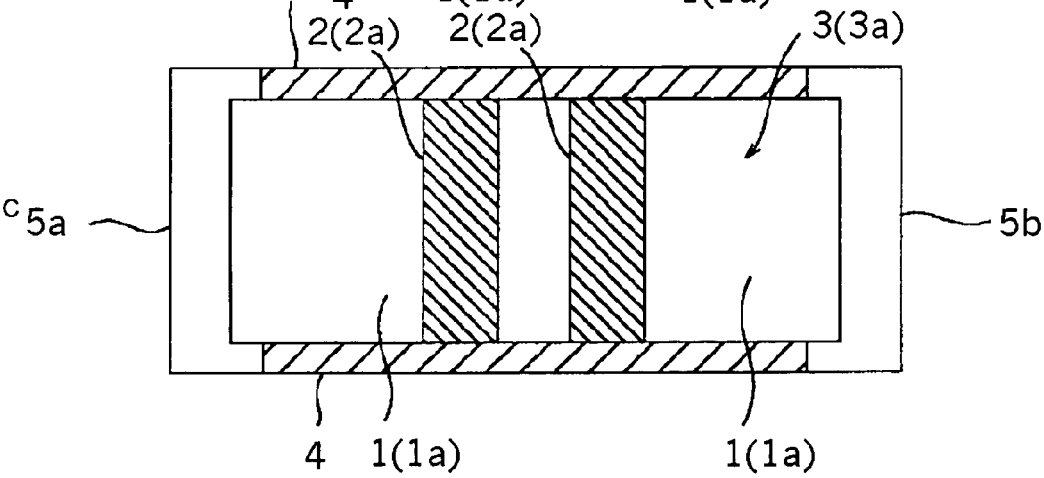
Figure 2C:
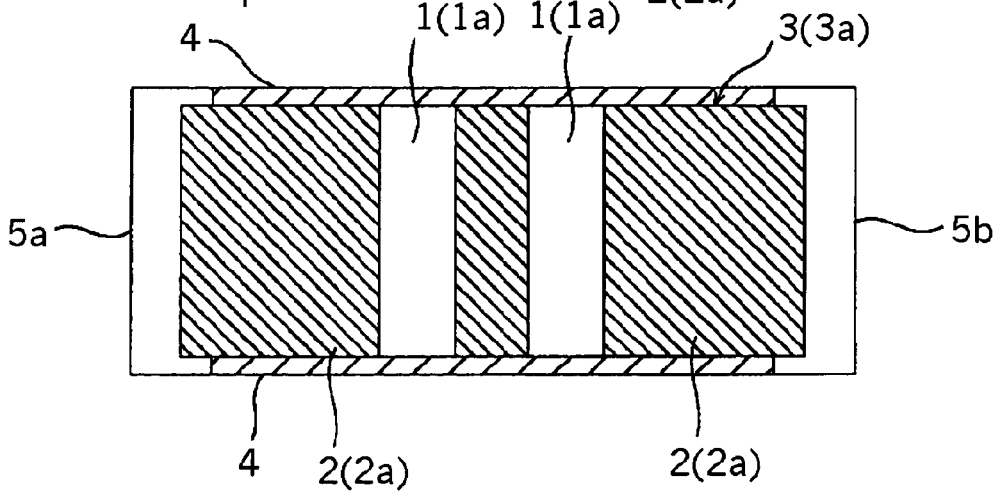

Also prepared are the composite 3 (sample number 22) formed by alternately laminating three semiconductive ceramic blocks 1*a* and two metal oxide blocks 2*a*, as shown in FIG. 1C; the composite 3 (sample number 23) formed by alternately laminating four semiconductive ceramic blocks 1*a* and three metal oxide blocks 2*a*, not shown in the drawings; the composite 3 (sample number 25) formed by alternately laminating three metal oxide blocks 2*a* and two semiconductive ceramic blocks 1*a*, as shown in FIG. 2C; and the composite 3 (sample number 26) formed by alternately laminating four metal oxide blocks 2*a* and three semiconductive ceramic blocks 1*a*, not shown in the drawings.

(6) The clamped composites 3 were cut to 0.5 mm square by a dicer, degreased at 600° C., and fired at 1300° C.

(7) As shown in FIGS. 1B, 2B, and 3B, glass paste, which is an insulator, was applied on four surfaces of each fired composite 3*a* parallel to the lamination direction. This paste was fired to form four insulating layers 4 on each composite 3*a*.

(8) Electrode paste was applied on the other two surfaces (the end surfaces) of each fired composite 3*a* to form a pair of electrodes 5*a* and 5*b* on each composite 3*a*, providing voltage-dependent resistors of the present invention.

To achieve an ohmic contact between the electrodes 5*a* and 5*b* and the composites 3*a*, if the outermost layers after firing the composites 3*a* are the semiconductive ceramic layer 1*a* which is made of mainly ZnO as in FIGS. 1A and 1B, Zn electrodes are formed. If the outermost layers are a metal-oxidation compound as in FIGS. 2A and 2B, gold electrodes are formed.

As in FIGS. 3A and 3B, when the outermost layers have both the semiconductor ceramics layers mainly made of ZnO and the metal-oxidation compound, the Zn electrodes are formed on the semiconductor ceramics layers and the Au electrodes are formed on the metal-oxidation compound. The samples (voltage-dependent resistors) were examined for voltage-current characteristics to determine the breakdown voltage V (1 mA) and voltage nonlinearity coefficient α of each sample, where the break down voltage V (1 mA) is a voltage between the both ends of the sample when a direct current of 1 mA flows through the sample.

The voltage nonlinearity coefficient α was determined by the following formula:

$$\alpha=[\log\{I(1\text{ mA})/I(0.1\text{ mA})\}]/[\log\{V(1\text{ mA})/V(0.1\text{ mA})\}],$$

where V (1 mA) is the breakdown voltage; and V (0.1 mA) is a voltage between the both ends of the sample when a direct current of 0.1 mA flows through the sample.

Then, a voltage V (1 $\mu$A) across each sample when a direct current of 1 $\mu$A flows through the sample was measured, and the ratio of the voltage V (1 $\mu$A) to the breakdown voltage V (1 mA) was determined by the following formula:

$$V(1\ \mu A)/V(1\text{ mA}).$$

A surge current having a triangular waveform of 8×20 microseconds and a current peak of 1 A was applied on each sample to measure a clamping voltage V (1 A) between the both ends of the sample. The ratio of the measured clamping voltage V (1 A) to the breakdown voltage V (1 mA) was determined by the following formula:

$$V(1\text{ A})/V(1\text{ mA}).$$

Each sample was examined for a change (%) in varistor voltage when a surge current having a triangular waveform of 8×20 microseconds and a current peak of 50 A was applied on the sample.

Each sample was examined for a change in the breakdown voltage V (1 mA) after a power test in which a power of 3 W/mm$^3$ is distributed to the sample for 10 seconds.

These results are shown in Tables 3 and 4.

TABLE 3

| Sample number | Device structure | Type of semiconductive ceramic material | Type of metal oxide material | Number of semiconductive ceramic layers | Number of metal oxide layers | V(1 mA) (V) | Variation in V(1 mA) | α | V(1 $\mu$A)/V(1 mA) | V(1 A)/V(1 mA) | Change in varistor voltage (%) | Firing temperature (° C.) | Change in V (1 mA) after power test |
|---|---|---|---|---|---|---|---|---|---|---|---|---|---|
| 1 | a | Z-c | A | 2 | 1 | 4.05 | 0.21 | 45.9 | 0.85 | 1.53 | 0.3 | 1300 | <0.5 |
| 2 | a | Z-c | B | 2 | 1 | 3.89 | 0.23 | 43.7 | 0.86 | 1.62 | 0.4 | 1300 | <0.5 |
| 3 | a | Z-c | C | 2 | 1 | 4.02 | 0.18 | 45.9 | 0.91 | 1.55 | 1.9 | 1300 | <0.5 |
| 4 | a | Z-c | D | 2 | 1 | 3.85 | 0.21 | 46.2 | 0.85 | 1.53 | 1.5 | 1300 | <0.5 |
| 5 | a | Z-c | E | 2 | 1 | 3.85 | 0.15 | 41.6 | 0.88 | 1.61 | 0.5 | 1300 | <0.5 |
| 6 | a | Z-c | F | 2 | 1 | 3.76 | 0.20 | 40.8 | 0.83 | 1.52 | 1.0 | 1300 | <0.5 |
| 7 | a | Z-c | G | 2 | 1 | 3.81 | 0.25 | 39.8 | 0.84 | 1.65 | 0.9 | 1300 | <0.5 |
| 8 | a | Z-c | H | 2 | 1 | 3.67 | 0.19 | 43.2 | 0.85 | 1.55 | 1.1 | 1300 | <0.5 |
| 9 | a | Z-c | I | 2 | 1 | 4.76 | 0.52 | 31.2 | 0.92 | 1.76 | 3.4 | 1300 | <0.5 |
| 10 | a | Z-c | J | 2 | 1 | 4.25 | 0.36 | 38.7 | 0.90 | 1.63 | 1.7 | 1300 | <0.5 |
| 11 | a | Z-c | K | 2 | 1 | 3.65 | 0.23 | 45.0 | 0.86 | 1.54 | 1.3 | 1300 | <0.5 |
| 12 | a | Z-c | L | 2 | 1 | 4.00 | 0.15 | 49.7 | 0.85 | 1.52 | 1.0 | 1300 | <0.5 |
| 13‡ | a | Z-c | M | 2 | 1 | 3.78 | 0.16 | 48.6 | 0.52 | 1.55 | 5.4 | 1300 | <0.5 |
| 14 | a | Z-c | N | 2 | 1 | 3.52 | 0.21 | 45.7 | 0.87 | 1.54 | 0.6 | 1300 | <0.5 |
| 15 | a | Z-a | A | 2 | 1 | 4.05 | 0.12 | 46.3 | 0.95 | 1.72 | 2.8 | 1300 | <0.5 |

*Sample number 13 (metal oxide material M) is outside the scope of the present invention.

TABLE 4

| Sample number | Device structure | Type of semiconductive ceramic material | Type of metal oxide material | Number of semiconductive ceramic layers | Number of metal oxide layers | V(1 mA) (V) | Variation in V(1 mA) | α | V(1 $\mu$A)/V(1 mA) | V(1 A)/V(1 mA) | Change in varistor voltage (%) | Firing temperature (° C.) | Change in V (1 mA) after power test |
|---|---|---|---|---|---|---|---|---|---|---|---|---|---|
| 16 | a | Z-b | A | 2 | 1 | 4.03 | 0.15 | 46.0 | 0.87 | 1.64 | 1.7 | 1300 | <0.5 |
| 17 | a | Z-c | A | 2 | 1 | 4.05 | 0.21 | 45.9 | 0.85 | 1.53 | 0.3 | 1300 | <0.5 |
| 18 | a | Z-d | A | 2 | 1 | 4.05 | 0.22 | 43.2 | 0.82 | 1.50 | 0.3 | 1300 | <0.5 |
| 19 | a | Z-e | A | 2 | 1 | 4.00 | 0.30 | 40.6 | 0.78 | 1.48 | 0.5 | 1300 | <0.5 |
| 20 | a | Z-f | A | 2 | 1 | 3.96 | 0.22 | 44.7 | 0.86 | 1.54 | 0.5 | 1300 | <0.5 |
| 21 | a | Z-g | A | 2 | 1 | 4.16 | 0.18 | 46.2 | 0.87 | 1.52 | 0.4 | 1300 | <0.5 |
| 22 | a | Z-c | A | 3 | 2 | 8.11 | 0.40 | 52.7 | 0.85 | 1.51 | 0.4 | 1300 | <0-5 |
| 23 | a | Z-c | A | 4 | 3 | 12.3 | 0.55 | 53.6 | 0.87 | 1.49 | 0.4 | 1300 | <0.5 |
| 24 | b | Z-c | A | 1 | 2 | 3.98 | 0.17 | 44.8 | 0.86 | 1.52 | 0.5 | 1300 | <0.5 |
| 25 | b | Z-c | A | 2 | 3 | 7.98 | 0.38 | 52.1 | 0.87 | 1.49 | 0.5 | 1300 | <0.5 |
| 26 | b | Z-c | A | 3 | 4 | 11.05 | 0.52 | 53.5 | 0.88 | 1.48 | 0.5 | 1300 | <0.5 |
| 27[1)] | c | Z-c | A | 1 | 1 | R 3.75 | 0.09 | 52.8 | 0.87 | 1.48 | 0.8 | 1300 | <0.5 |
| | | | | | | F 0.35 | 0.14 | 12.8 | 5.5 | 2.23 | 0.2 | | |
| 28 | a | Z-c | A | 2 | 1 | 4.12 | 0.31 | 40.8 | 0.87 | 1.61 | 1.5 | 1200 | <0.5 |
| 29 | a | Z-c | A | 2 | 1 | 4.08 | 0.25 | 42.5 | 0.87 | 1.57 | 0.9 | 1250 | <0.5 |
| 30 | a | Z-c | A | 2 | 1 | 4.00 | 0.20 | 46.1 | 0.85 | 1.51 | 0.3 | 1350 | <0.5 |
| Commercially available multilayer varistor | | | L: 1.6 mm W: 0.8 mm T: 0.8 mm | | | 8.75 | 2.54 | 24.7 | 0.75 | 1.65 | 5.9 | — | Burnout |

[1)]R indicates a direction when the semiconductive ceramic layer is the positive side In the column of device structures in Tables 3 and 4, a indicates a structure as shown in FIG. 1B, b indicates a structure as shown in FIG. 2B, and c indicates a structure as shown in FIG. 3B.

According to Tables 3 and 4, the samples that meet the requirements for the present invention have excellent characteristics and, therefore, can be put to practical use. On the other hand, sample number 13, which contains $SrCO_3$ in the molar ratio of 0.5 and deviates from the scope of the present invention (the molar ratio of $x \leqq 0.4$), has a smaller value of V (1 $\mu$A)/V(1 mA) and a larger change in the varistor voltage.

In addition, the samples that meet the requirements for the present invention have generally smaller values of V (1 mA), smaller variations in V (1 mA), and smaller changes in the varistor voltage than a commercially available multilayer varistor having a size of 1.6×0.8×0.8 mm as in Patent Document 1.

In Table 4, sample numbers 28, 29, and 30 are samples that have the same structure and composition as sample number 1 and that are fired at 1200° C., 1250° C., and 1350° C., respectively.

A comparison between sample numbers 28, 29, and 30 and sample number 1 shows that different firing temperatures within the range of 1200° C. to 1350° C. cause little difference in electrical characteristics. A larger firing temperature leads to a faster crystal growth, which also has little effect on the electrical characteristics.

Sample numbers 1 to 30 exhibited changes less than 0.5 in the breakdown voltage V (1 mA) after the power test, while the commercially available multilayer varistor was burned out after the power test.

The voltage-dependent resistors of the present invention, therefore, can achieve excellent characteristics and little variations more easily than known varistors that require grain diameter control.

The present invention is not limited to the above embodiments. A wide variety of applications and modifications in, for example, the compositions of the semiconductive ceramic sheets and metal oxide sheets, the number of laminated sheets, and the disposition of the electrodes 5*a* and 5*b*, are permitted within the scope of the present invention.

What is claimed is:

1. A voltage-dependent resistor comprising:

a composite of at least one semiconductive ceramic layer containing ZnO and at least one metal oxide layer containing at least one of strontium and barium, at least one of manganese and cobalt, and at least one rare earth element, the composite including at least one junction of said at least one semiconductive ceramic layer and said at least one metal oxide layer; and electrodes disposed at predetermined positions on the composite so as to enable current to flow through said at least one junction, wherein material for said at least one metal oxide layer is represented by the formula:

$$M_{1-x}A_xBO_3$$

where M indicates said at least one rare earth element; A indicates said at least one of strontium and barium; B indicates said at least one of manganese and cobalt; and $x \leqq 0.4$.

2. A voltage-dependent resistor according to claim 1, wherein the material for said at least one metal oxide layer is $La_{1-x}Sr_xMnO_3$.

3. A voltage-dependent resistor according to claim 1, wherein a potential barrier is formed at said at least one junction of said at least one semiconductive ceramic layer and said at least one metal oxide layer.

4. A voltage-dependent resistor according to claim 1, wherein said at least one semiconductive ceramic layer and said at least one metal oxide layer have a resistivity of about 0.001 to several Ω·mm.

5. A voltage-dependent resistor according to claim 1, wherein an electrode is not required at said at least one junction of said at least one semiconductive ceramic layer and said at least one metal oxide layer.

6. A voltage-dependent resistor according to claim 1, wherein said at least one semiconductive ceramic layer is doped with a trivalent dopant.

7. A voltage-dependent resistor according to claim 6, wherein an amount of said trivalent dopant is about 100 ppm or less.

8. A voltage-dependent resistor according to claim 1, wherein the total number of said at least one semiconductive ceramic layer and said at least one metal oxide layer is at least three.

9. A voltage-dependent resistor according to claim 1, wherein said voltage-dependent resistor has a breakdown voltage of approximately a multiple of 4V.

10. A voltage-dependent resistor according to claim 1, wherein insulating layers are formed on surfaces on which said electrodes are not formed.

11. A voltage-dependent resistor according to claim 1, wherein said composite is formed by co-firing said at least one semiconductive ceramic layer and said at least one metal oxide layer.

12. A voltage-dependent resistor according to claim 1, wherein said at least one semiconductive ceramic layer and said at least one metal oxide layer do not diffuse into each other at said at least one junction when at least one of power and heat is applied to said voltage-dependent resistor.

* * * * *